US009269487B2

(12) United States Patent
Yoshida

(10) Patent No.: US 9,269,487 B2
(45) Date of Patent: Feb. 23, 2016

(54) COMMON MODE NOISE FILTER AND PRODUCTION METHOD THEREFOR

(75) Inventor: Noritaka Yoshida, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/238,181

(22) PCT Filed: Sep. 13, 2012

(86) PCT No.: PCT/JP2012/005829

§ 371 (c)(1),
(2), (4) Date: Feb. 10, 2014

(87) PCT Pub. No.: WO2013/038671

PCT Pub. Date: Mar. 21, 2013

(65) Prior Publication Data

US 2014/0191838 A1 Jul. 10, 2014

(30) Foreign Application Priority Data

Sep. 15, 2011 (JP) ..... 2011-201437
Sep. 15, 2011 (JP) ..... 2011-201438

(51) Int. Cl.
*H01F 5/00* (2006.01)
*H01F 27/28* (2006.01)
*H01F 17/00* (2006.01)

(52) U.S. Cl.
CPC ..... *H01F 27/2804* (2013.01); *H01F 17/0013* (2013.01); *H01F 2017/0066* (2013.01); *H01F 2017/0093* (2013.01)

(58) Field of Classification Search
CPC ..... H01F 5/002; H01F 5/06; H01F 17/0006; H01F 17/0013; H01F 27/2804; H01F 2017/0093; H01F 2017/0066
USPC ..... 336/200, 233, 234, 83
See application file for complete search history.

(56) References Cited

U.S. PATENT DOCUMENTS 6,924,972 B2 * 8/2005 Takazawa ..... 361/321.2

(Continued)

FOREIGN PATENT DOCUMENTS

| | | | |
|---|---|---|---|
| JP | 11-067575 | A | 3/1999 |
| JP | 2003-124028 | A | 4/2003 |
| JP | 2004-235494 | A | 8/2004 |
| JP | 2006-303209 | A | 11/2006 |
| JP | 2008-300432 | A | 12/2008 |

(Continued)

OTHER PUBLICATIONS

International Search Report issued in International Application No. PCT/JP2012/005829 with Date of mailing Nov. 6, 2012, with English Translation.

*Primary Examiner* — Mangtin Lian
(74) *Attorney, Agent, or Firm* — McDermott Will & Emery LLP

(57) ABSTRACT

A common mode noise filter includes a first insulating layer, a first coil conductor on an upper surface of the first insulating layer, a second coil conductor on a lower surface of the first insulating layer, a second insulating layer on the upper surface of the first insulating layer to cover the first coil conductor, a third insulating layer on a lower surface of the second insulating layer to cover the second coil conductor. The first insulating layer contains glass and inorganic filler, and contains pores dispersed therein. The second insulating layer covers the first coil conductor, contains glass and inorganic filler, and contains pores dispersed therein. The third insulating layer covers the second coil conductor, contains glass and inorganic filler, and contains pores dispersed therein. This common mode noise filter has excellent high-frequency characteristics at a high yield rate.

20 Claims, 12 Drawing Sheets

(56) References Cited

U.S. PATENT DOCUMENTS

| | | | | |
|---|---|---|---|---|
| 2009/0003191 | A1* | 1/2009 | Inuzuka et al. | 369/283 |
| 2009/0283306 | A1 | 11/2009 | Nishino | |
| 2010/0201473 | A1* | 8/2010 | Konoue et al. | 336/200 |
| 2011/0181384 | A1* | 7/2011 | Inuduka et al. | 336/234 |

FOREIGN PATENT DOCUMENTS

| | | | |
|---|---|---|---|
| JP | 2010-098199 | A | 4/2010 |
| JP | 2010-206089 | A | 9/2010 |
| JP | 2011-003567 | A | 1/2011 |
| WO | 2008-093669 | A1 | 8/2008 |

* cited by examiner

FIG. 7

| Sample No. | 1 | 2 | 3 | 4 | 5 | 6 |
|---|---|---|---|---|---|---|
| Thicknesses of Insulating Layers 11b and 11c (μm) | 0 (N/A) | 3 | 5 | 10 | 15 | 25 |
| Thicknesses of Insulating Layers 16d and 16e (μm) | 25 | 22 | 20 | 15 | 10 | 0 (N/A) |
| Crack Production Rate | 41/50 | 5/50 | 0/50 | 0/50 | 0/50 | 0/50 |

FIG. 12

| Sample No. | 7 | 8 | 9 | 10 | 11 | 12 |
|---|---|---|---|---|---|---|
| Thicknesses of Insulating Layers 11d and 11e (μm) | 0 (N/A) | 3 | 5 | 10 | 35 | 70 |
| Delamination-Exhibiting Rate | 37/50 | 7/50 | 0/50 | 0/50 | 0/50 | 0/50 |

COMMON MODE NOISE FILTER AND PRODUCTION METHOD THEREFOR

RELATED APPLICATIONS

This application is the U.S. National Phase under 35 U.S.C. §371 of International Application No. PCT/JP2012/005829, filed on Sep. 13, 2012, which in turn claims the benefit of Japanese Application No. 2011-201437, filed on Sep. 15, 2011 and Japanese Application No. 2011-201438, filed on Sep. 15, 2011, the disclosures of which Applications are incorporated by reference herein.

TECHNICAL FIELD

The present invention relates to a common mode noise filter having a pair of coil conductors sandwiched by magnetic substrates, and it also relates to a method for manufacturing the same filter.

BACKGROUND ART

In recent years, a high-speed interface, such as a universal serial bus (USB) and an high-definition multimedia interface (HDMI), has been upgraded to work with a higher speed. This market trend invites a problem of how to deal with radiated noise. A common mode noise may cause the unintended noises, so that the market may demand a common mode noise filter working at the higher frequency in order to remove common mode noises.

The common mode noise filter includes two coils wound in the same direction. An electric current flowing through a coil generates a magnetic field, so that a self-inductance produces a braking effect.

The two coils of the common mode noise filter utilize an interaction between the coils for preventing an electric current of a common mode noise from passing through. To be more specific, when currents in differential mode flow through the two coils, the currents flow in directions opposite to each other, so that magnetic fluxes generated by the currents cancel each other smooth the currents. However, the currents of the common mode noise flows in the same direction cause the magnetic fluxes generated in the coils to be combined together and strengthened by each other. As a result, a greater braking effect is produced due to electromotive force of the self-inductance, and prevents the current of the common mode noise from passing through.

Patent Literature 1 discloses a common mode noise filter including plural conductive coil patterns and insulating layers stacked between a pair of layers made of magnetic oxide. The pair of layers is made of Ni—Zn—Cu based ferrite, and the insulating layers are made of Cu—Zn based ferrite or Zn based ferrite.

This common mode noise filter is expected to exercise its function more effectively by getting the two coils closer to each other, thereby combining and strengthening magnetic fluxes generated. The stronger braking effect can be thus obtained. However, a closer placement of the two coils to each other will generate a large amount of a stray capacitance between the coils to produce a resonance, and prevents an electric current of a high-frequency signal from passing through.

Since electronic devices work at a higher frequency in recent years, glass-based materials are widely used for an insulating layer. In general, a dielectric constant of glass-based material which contains silica-based filler of a low dielectric constant and is used as an additive ranges from 4 to 6 while a dielectric constant of ferrite material ranges from 10 to 15. The noise filter disclosed in Patent Literature 2 includes insulating layers made of glass-based material to reduce a stray capacitance between the coils. As a result, this noise filter has better performance than a noise filter that employs insulating layers made of conventional non-magnetic ferrite material.

Patent Literature 3 discloses a ceramic electronic component and a method for manufacturing the same component. This ceramic electronic component employs a material having pores therein and a low dielectric constant. Insulating layers are laminated between a pair of coil conductors confronting each other, thereby forming a laminated body. Each of the insulating layers is made of glass-based material and has multiple pores therein. This laminated body reduces appreciably the stray capacitance between the coils. As a result, a common mode noise filter phenomenally excellent in high-frequency characteristics can be obtained.

However, in the case that the magnetic oxide layers are made of Ni—Zn—Cu based ferrite, each of the elements (i.e. magnetic oxide layers, insulating layers, and coil conductors) is made of materials different from each other. The laminated body can hardly be formed unitarily by firing these elements simultaneously free from structural failures, such as cracks or delamination between the layers. On top of that, even if an appropriate firing condition is found to the simultaneous firing of respective layers of the laminated body, and the laminated body could be formed unitarily, there is still a problem: During a heat-treat step (e.g. baking an external terminal electrode printed on the laminated body) after the firing step, cracks can be sometimes produced in the insulating layers between the coil conductors.

CITATION LIST

Patent Literature

Patent Literature 1: Japanese Patent Laid-Open Publication No. 2003-124028

Patent Literature 2: Japanese Patent Laid-Open Publication No. 2004-235494

Patent Literature 3: Japanese Patent Laid-Open Publication No. 11-067575

SUMMARY

A common mode noise filter includes a first insulating layer, a first coil conductor on an upper surface of the first insulating layer, a second coil conductor on a lower surface of the first insulating layer, a second insulating layer on the upper surface of the first insulating layer to cover the first coil conductor, a third insulating layer on a lower surface of the second insulating layer to cover the second coil conductor. The first insulating layer contains glass and inorganic filler, and contains pores dispersed therein. The second insulating layer covers the first coil conductor, contains glass and inorganic filler, and contains pores dispersed therein. The third insulating layer covers the second coil conductor, contains glass and inorganic filler, and contains pores dispersed therein.

This common mode noise filter has excellent high-frequency characteristics at a high yield.

BRIEF DESCRIPTION OF DRAWINGS

FIG. 7 shows a test result of the common mode noise filter in accordance with Embodiment 1.

FIG. 12 shows a test result of the common mode noise filter in accordance with Embodiment 2.

DETAIL DESCRIPTION OF PREFERRED EMBODIMENTS

Exemplary Embodiment 1

Figure 1:
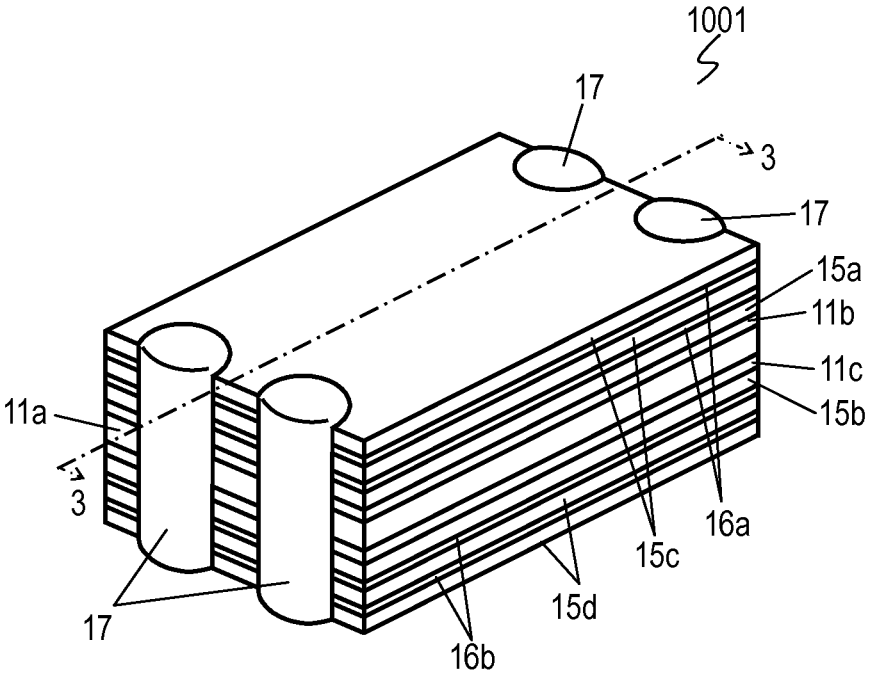
FIG. 1 is a perspective view of a common mode noise filter in accordance with Exemplary Embodiment 1 of the present invention.
Figure 2:
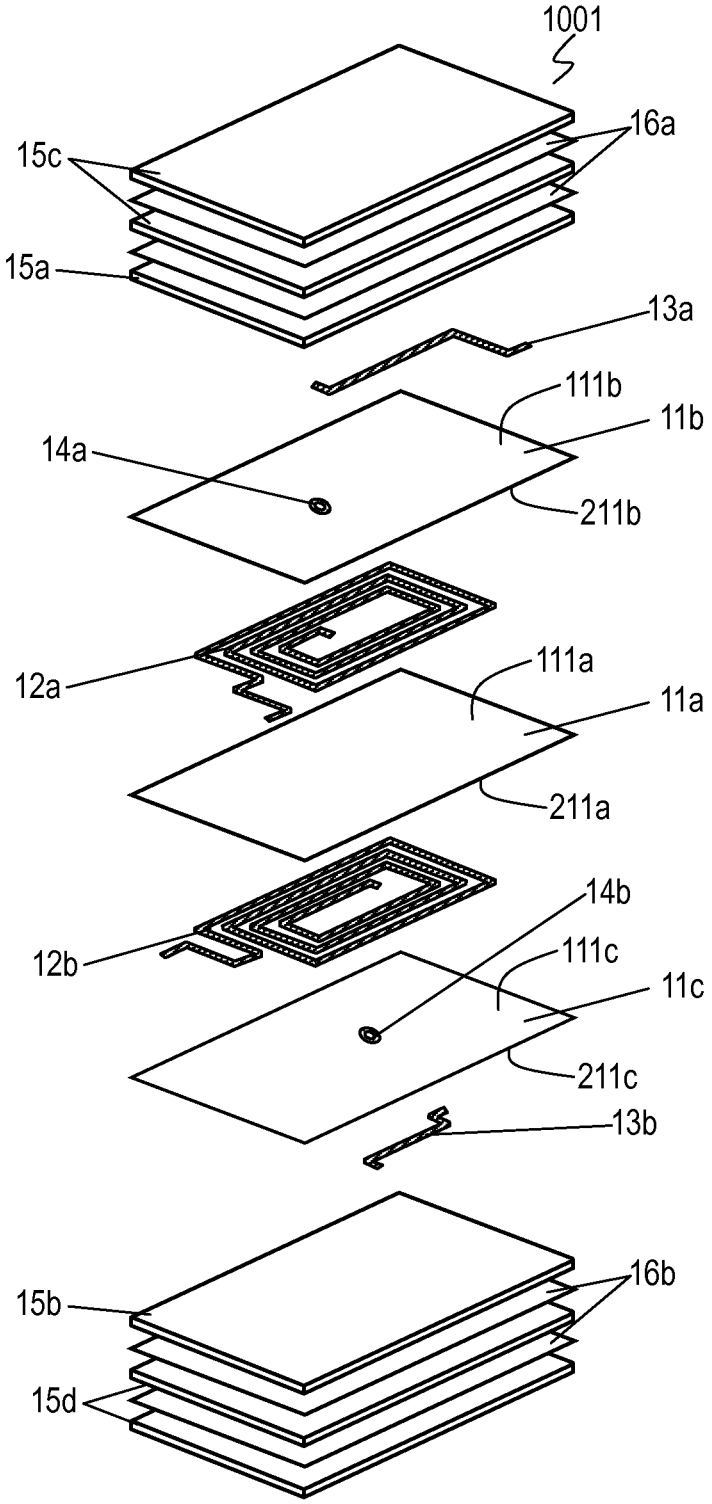
FIG. 2 is an exploded perspective view of the common mode noise filter in accordance with Embodiment 1.
Figure 3:
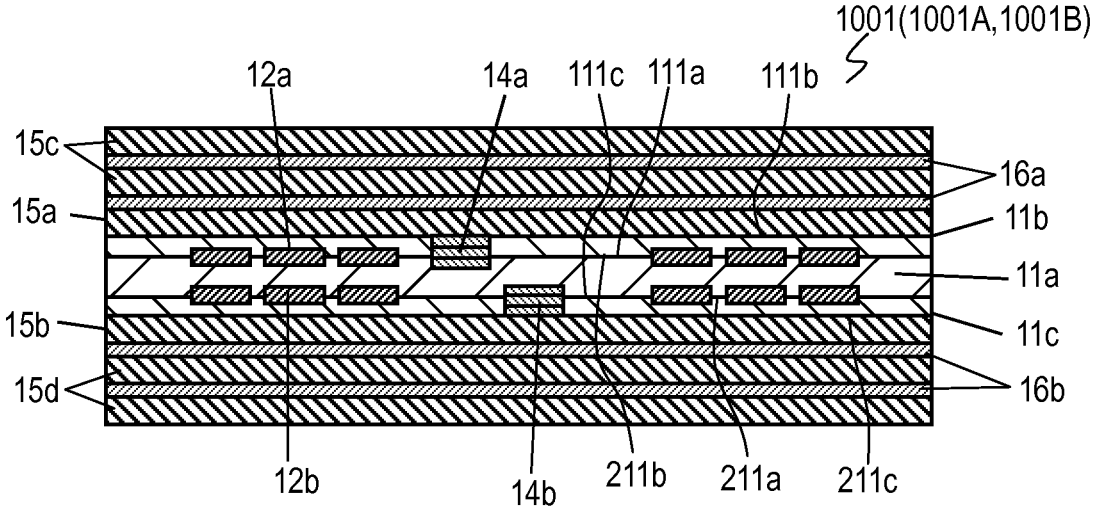
FIG. 3 is a cross-sectional view of the common mode noise filter at line 3-3 shown in FIG. 1.

FIGS. 1 and 2 are a perspective view and an exploded perspective view of common mode noise filter 1001 in accordance with Exemplary Embodiment 1 of the present invention. FIG. 3 is a cross-sectional view of common mode noise filter 1001 at line 3-3 shown in FIG. 1.

Common mode noise filter 1001 includes insulating layer 11*a*, coil conductor 12*a* disposed on upper surface 111*a* of insulating layer 11*a*, insulating layer 11*b* disposed on upper surface 111*a* of insulating layer 11*a* to contact coil conductor 12*a* to cover coil conductor 12*a*, coil conductor 12*b* disposed on lower surface 211*a* of insulating layer 11*a*, insulating layer 11*c* disposed on lower surface 211*a* of insulating layer 11*a* to contact coil conductor 12*b* to cover coil conductor 12*b*, magnetic oxide layer 15*a* disposed on upper surface 111*b* of insulating layer 11*b*, magnetic oxide layer 15*b* disposed on lower surface 211*c* of insulating layer 11*c*, leading electrode 13*a* electrically connected to coil conductor 12*a*, via-electrode 14*a* for connecting coil conductor 12*a* to leading electrode 13*a*, leading electrode 13*b* electrically connected to coil conductor 12*b*, via-electrode 14*b* for connecting coil conductor 12*b* to leading electrode 13*b*, and external terminal electrodes 17. External terminal electrodes 17 are connected to coil conductors 12*a* and 12*b* and leading electrodes 13*a* and 13*b*. Common mode noise filter 1001 may further include one or more magnetic oxide layers 15*c* made of the same material as magnetic oxide layer 15*a*, one or more magnetic oxide layers 15*d* made of the same material as magnetic oxide layer 15*b*, one or more insulating layers 16*a*, and one or more insulating layers 16*b*. Insulating layers 16*a* are stacked alternately on magnetic oxide layer 15*a* and magnetic oxide layers 15*c*. Insulating layer 16*b* is layered such that it is sandwiched by magnetic oxide layer 15*b* and magnetic oxide layer 15*d*. Leading electrode 13*a* is disposed on upper surface 111*b* of insulating layer 11*b*. Via-electrode 14*a* penetrates insulating layer 11*b* from upper surface 111*b* to lower surface 211*b*. Magnetic oxide layer 15*a* is disposed on upper surface 111*b* of insulating layer 11*b* to contact and cover leading electrode 13*a*. Leading electrode 13*b* is disposed on lower surface 211*c* of insulating layer 11*c*. Via-electrode 14*b* penetrates insulating layer 11*c* from upper surface 111*c* to lower surface 211*c*. Magnetic oxide layer 15*b* is disposed on lower surface 211*c* of insulating layer 11*c* to contact and cover leading electrode 13*b*.

Insulating layer 11*a* contains borosilicate glass and inorganic filler. Insulating layers 11*a*, 11*b*, and 11*c* are provided between magnetic oxide layers 15*a* and 15*b*. Insulating layers 16*a* and 16*b* contain glass component but contain no pores dispersed therein. Insulating layers 11*a*, 11*b*, and 11*c* is different from magnetic oxide layers 15*a*, 15*b*, 15*c*, and 15*d* in that Insulating layers 11*a*, 11*b*, and 11*c* are non-magnetic layers having substantially no magnetic property.

Magnetic oxide layers 15*a*, 15*b*, 15*c*, and 15*d* are made of magnetic material, such as ferrite mainly made of $Fe_2O_3$. According to Embodiment 1, the total number of magnetic oxide layers 15*a* and 15*c* is three, and that of insulating layers 16*a* is two. The total number of magnetic oxide layers 15*b* and 15*d* is three, and that of insulating layers 16*b* is two. Insulating layers 16*a* and magnetic oxide layers 15*c* and 15*a* are arranged alternately. Insulating layers 16*b* and magnetic oxide layers 15*b* and 15*d* are arranged alternately. This structure increases adhesive strength between external terminal electrodes 17 and filter 1001. Contraction behavior due to the firing of magnetic oxide layers 15*a*, 15*b*, 15*c*, and 15*d* which are made of material different from that of insulating layer 11*a* becomes more similar to that of insulating layer 11*a*, accordingly preventing cracks or delamination between the layers. The total number of layers 15*a* and 15*c* can be two, and the total number of layers 15*b* and 15*d* can be also two. Common mode noise filter 1001 does not necessarily include insulating layers 16*a* and 16*b* containing glass component.

Coil conductors 12*a* and 12*b* can be formed by shaping a conductive material, such as Ag, into a spiral shape, and plating the spiral shape. Coil conductors 12*a* and 12*b* are electrically connected to leading electrodes 13*a* and 13*b* through via-electrodes 14*a* and 14*b*, respectively.

The shape of coil conductors 12*a* and 12*b* is not necessarily the spiral shape, and can be helical, meander or other shapes. Coil conductors 12*a* and 12*b* are not necessarily plated, but can be formed by printing, depositing or other methods.

Figure 4:
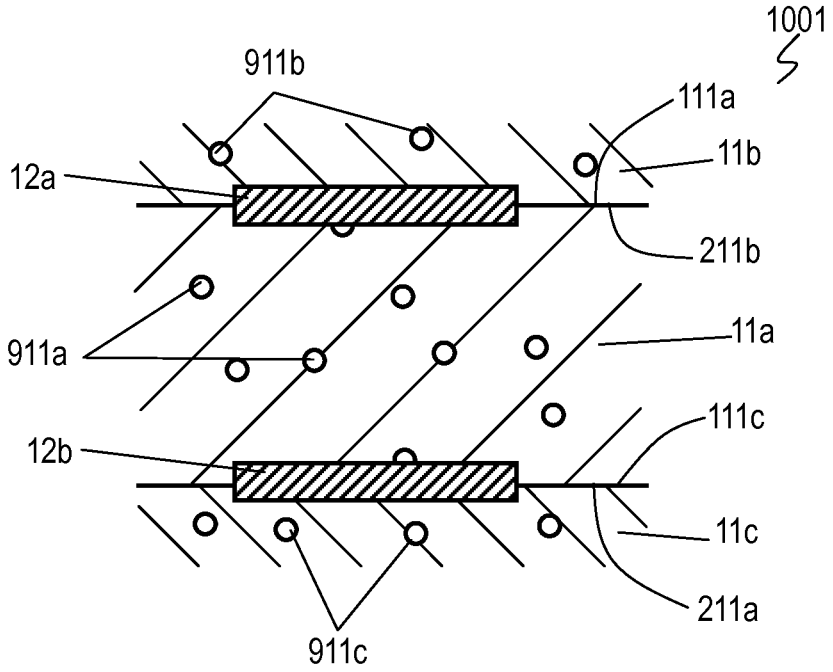
FIG. 4 is an enlarged cross-sectional view of the common mode noise filter shown in FIG. 1.

FIG. 4 is an enlarged cross-sectional view of common mode noise filter 1001. Pores 911*a* are dispersed in insulating layer 11*a*. Pores 911*b* are dispersed in insulating layer 11*b*. Pores 911*c* are dispersed in insulating layer 11*c*. This structure reduces an effective dielectric constant of insulating layer 11*a*, and relieving stress concentrating on insulating layer 11*a* during heat-treating after the firing, thereby preventing cracks around coil conductors 12*a* and 12*b*.

A pore ratio which is a ratio of a total volume of pores 911*a* to the volume of insulating layer 11*a* preferably ranges from 5 to 40 vol. %. A pore ratio which is a ratio of a total volume of pores 911*b* to the volume of insulating layer 11*b* preferably ranges from 5 to 40 vol. %. A pore ratio which is a ratio of a total volume of pores 911*c* to the volume of insulating layer 11*c* preferably ranges from 5 to 40 vol. %. This structure reduces the dielectric constant of insulating layer 11*a* appropriately while maintaining the material strength thereof.

Inorganic foaming agent which is thermally discomposed and to generate gas in a temperature range including the firing temperature and its vicinity is preferably mixed with glass powder and inorganic filler powder which are powder of material of insulating layers 11*a* to 11*c* to form pores 911*a* to 911*c* in insulating layers 11*a* to 11*c*.

In order to form pores in glass or ceramics, disappearing particles or hollow particles which disappear during the firing can be added to the material powder. The disappearing particles can be particles of resin, such as polyethylene.

However, the method of making pores employing the resin particles as disappearing particles causes the resin particles to disappear up to about 500° C. The resin particles tends to form pores open to surfaces of insulating layers 11*a* to 11*c* and communicating with each other in order to obtain the pore ratios within the above range. These pores may readily absorb moisture and degrade reliability. If the materials are sintered to prevent the open and communicating pores from being generated, the pore ratio may decrease.

The method of forming the pores employing the hollow particles does not produce the open pores theoretically, so that a material of the electrode does not enter into the pores or bite the pores. This structure prevents the adhesive strength between coil conductors 12*a* and 12*b* and the insulating layers from increasing. Further, the hollow particles are generally expensive, so that this method increases the manufacturing cost.

In the above method employing the inorganic foaming agent as an additive, the contraction of insulating layers 11*a* to 11*c* due to the firing progresses to a certain degree in the firing temperature range, and melt liquid of the glass wets the filler and the inorganic foaming agent. Then, the foaming agent is thermally decomposed and generates gas. This mechanism allows the gas to be appropriately trapped in the glass, hence producing independent closed pores densely. This method thus can provide a high pore ratio easily, and form independent closed pores, hence securing the adhesive strength between coil conductors 12*a* and 12*b* and insulating layers 11*a* to 11*c* easily.

The open pore is a pore having a portion communicating with an outside of the glass-based material of the insulating layer. The closed pore is a pore that is formed inside the glass-based material and does not communicate with the outside of the glass-based material. The inorganic foaming agent preferably employs $CaCO_3$ or $SrCO_3$.

As discussed above, $CaCO_3$ or $SrCO_3$ is preferable as the inorganic foaming agent; however, $CaCO_3$ and $SrCO_3$ can be mixed together. As long as being discomposed at a temperature ranging from 600° C. to 1000° C., carbonate, nitrate, or sulfate can be used as the inorganic foaming agent. For instance, $BaCO_3$, $Al_2(SO_4)_3$, $Ce_2(SO_4)_3$ can be used as the inorganic foaming agent. A decomposition completion temperature at which the inorganic foaming agent is completed to decompose ranges from 600° C. to 1000° C., more preferably from 700° C. to 1000° C. The decomposition completion temperature within this range allows the gas generated during the temperature rise to be appropriately trapped inside insulating layers 11*a*, 11*b*, and 11*c*.

The decomposition completed temperature discussed above is a temperature at which weight reduction is completed in a TG chart. The TG chart is drawn by measuring the material powder of the foaming agent by a TG-DTA method (with TG8120 by RIGAKU Co. Ltd).

The amount of the inorganic foaming agent added preferably ranges from 1 wt % to 4 wt %. The amount of the inorganic foaming agent not larger than 5 wt % can hardly produce open and communicating pores which are formed of pores communicating with each other, hence allowing a water absorption rate of insulating layers 11*a*, 11*b*, and 11*c* to be not larger than 0.5%. This structure provides sufficient insulation reliability without providing any special treatment, such as resin impregnation.

The glass composition of the borosilicate glass of insulating layers 11*a* to 11*c* preferably contains $Al_2O_3$ in addition to $SiO_2$ and $B_2O_3$, and at least one material selected from oxide alkali metals. The glass composition desirably contains substantially no PbO in order not to avoid adverse effects on the environment.

The borosilicate glass of insulating layers 11*a* to 11*c* preferably has a yield point not lower than 550° C. and not higher than 750° C. If the yield point is lower than 550° C., the glass may deform significantly during the firing, and may have resistance to chemical reduced to provide a problem during plating. If the yield point exceeds 750° C., sufficient densification cannot be obtained in the temperature range in which coil conductors 12*a* and 12*b* and insulating layers 11*a* to 11*c* can be fired simultaneously.

The yield point of glass according to the embodiment is a temperature at which a glass state is transformed from expansion to contraction for a sample of glass having a bar shape and the temperature is measured by a TMA method with TMA8310 (made by RIGAKU Co., Ltd).

The inorganic filler in insulating layers 11*a* to 11*c* can be material, such as aluminum oxide, diopside, mulite, cordierite, or silica, resisting reacting with borosilicate glass during the firing. Cordierite or silica having a low dielectric constant is preferable for the inorganic filler since they can effectively reduce the dielectric constant of insulating layer 11*a* disposed between coil conductors 12*a* and 12*b*, the dielectric constant of insulating layer 11*b* disposed between coil conductor 12*a* and leading electrode 13*a*, and the dielectric constant of insulating layer 11*c* disposed between coil conductor 12*b* and leading electrode 13*b*.

Figure 5:
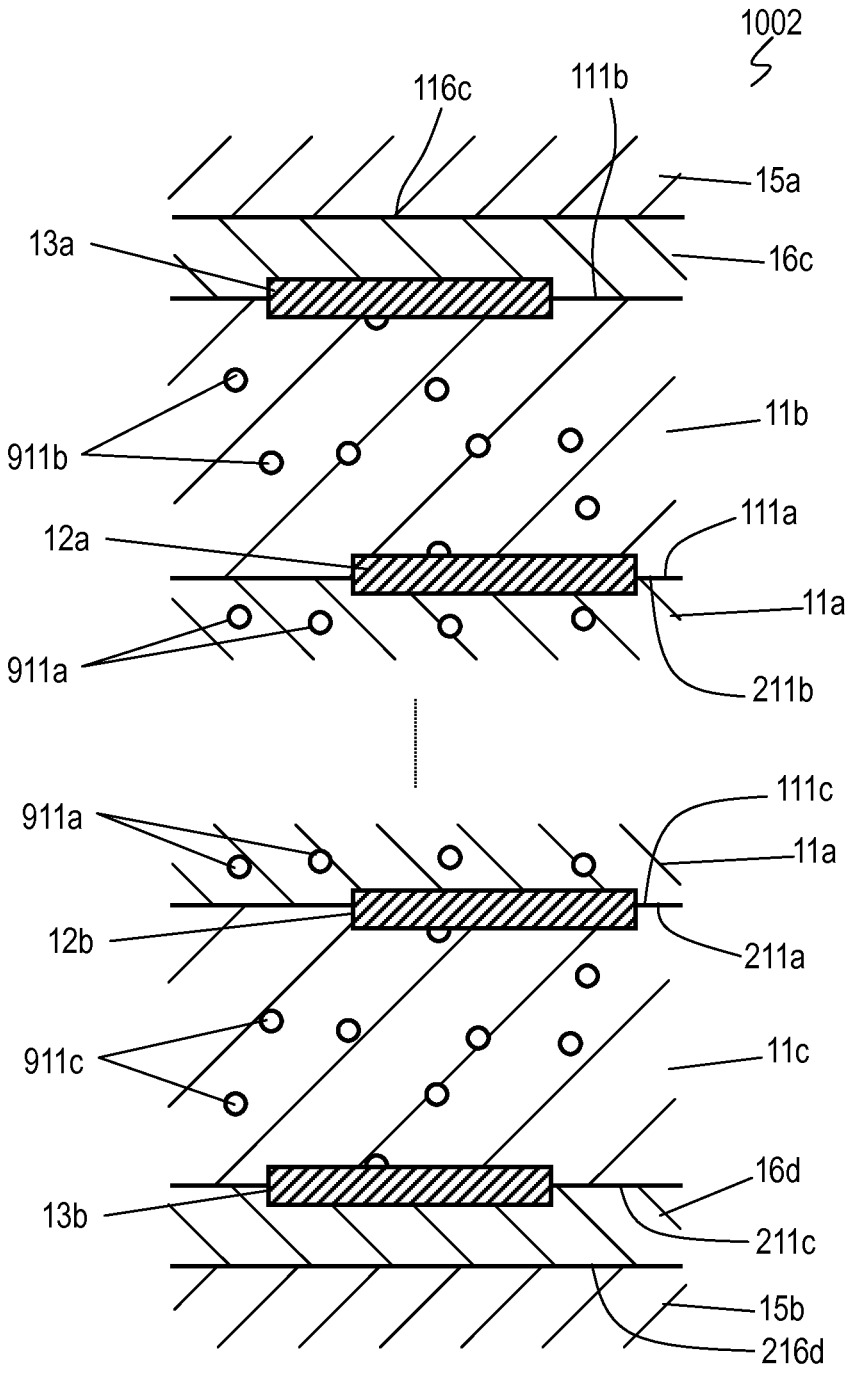
FIG. 5 is an enlarged cross-sectional view of another common mode noise filter in accordance with Embodiment 1.

FIG. 5 is an enlarged cross-sectional view of another common mode noise filter 1002 in accordance with Embodiment 1. In FIG. 5, components identical to those of common mode noise filter 1001 shown in FIGS. 3 and 4 are denoted by the same reference numerals. In filter 1002, insulating layer 16*c* containing glass component is disposed on upper surface 111*b* of insulating layer 11*b* to contact and cover leading electrode 13*a*. Magnetic oxide layer 15*a* is disposed on upper surface 116*c* of insulating layer 16*c*. Insulating layer 16*d* containing glass component is disposed on lower surface 211*c* of insulating layer 11*c* to contact and cover leading electrode 13*b*. Magnetic oxide layer 15*b* is disposed on lower surface 216*d* of insulating layer 16*d*. Magnetic oxide layers 15*a* and 15*b* thus do not contact leading electrodes 13*a* and 13*b*, respectively. Since magnetic oxide layers 15*a* and 15*b* can be hardly sintered in the temperature range in which magnetic oxide layers 15*a* and 15*b* can be fired simultaneously to Ag, magnetic oxide layers 15*a* and 15*b* located away from leading electrodes 13*a* and 13*b* increases the reliability of moisture absorption. Insulating layers 16*c* and 16*d* have no pores dispersed therein.

The above components of common mode noise filter 1001 (1002) are merged together for forming laminated body 1001A. Four external terminal electrodes 17 made of Ag are provided on both sides of laminated body 1001A. External terminal electrodes 17 are connected to coil conductors 12*a* and 12*b* and leading electrodes 13*a* and 13*b*. A nickel-plated layer or a tin-plated layer may be preferably provided on surfaces of external terminal electrodes 17 to prevent electrodes 17 from corrosion.

Figure 6:
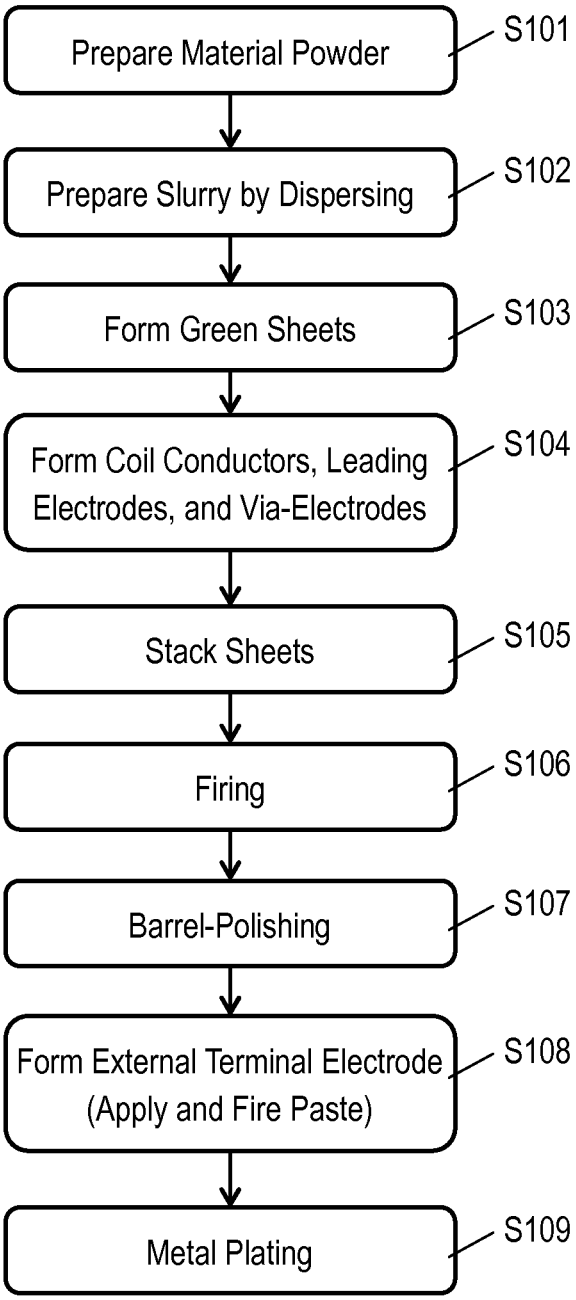
FIG. 6 is a schematic view of the common mode noise filter in accordance with Embodiment 1 for illustrating processes for manufacturing the filter.

A method for manufacturing common mode noise filter 1001 will be described below. FIG. 6 shows processes for manufacturing common mode noise filter 1001.

First, an insulating sheet constituting insulating layer 11*a* is provided: 63 wt & of borosilicate glass powder, 4 wt % of $SrCO_3$ powder, and 33 wt % of inorganic filler are mixed together to prepare mixed powder (Step S101). Then, butyral resin (PVB), acrylic resin, and butyl benzyl phthalate (BBP) plasticizer are mixed together to produce an organic binder. The above mixed powder is dispersed in this organic binder to prepare a slurry (Step S102).

Next, this slurry is applied onto a polyethylene terephthalate (PET) film by a doctor blade method to shape the slurry, thereby forming an insulating sheet, i.e., a green sheet (Step S103).

Insulating sheets constituting insulating layers 11*b* and 11*c* are provided. 63 wt % of borosilicate glass powder, 4 wt % of $SrCO_3$ powder, and 33 wt % of inorganic filler are mixed together to produce mixed powder. Then, a slurry is produced from this mixed powder, and shaped into the insulating sheets by the same production method for making the insulating sheet constituting insulating layer 11*a*.

Magnetic oxide sheets constituting magnetic oxide layers 15*a* to 15*d* are provided. 100 wt % of ferrite material powder is prepared. Then, a slurry is produced form this powder and shaped into magnetic oxide sheets by the same production method for the insulating sheet constituting insulating layer 11*a*.

Insulating sheets constituting insulating layers 16*a* and 16*b* are prepared. 69 wt % of borosilicate glass powder and 31 wt % of inorganic filler are mixed together to produce mixed powder. Then, a slurry is produced from this mixed powder and shaped into the insulating sheets by the same production method for the insulating sheet constituting insulating layer 11*a*.

According to Embodiment 1, as discussed above, insulating layer 11*a* is made of the same materials as insulating layers 11*b* and 11*c*, but may be made of different materials with the same effects as long as insulating layers 11*a*, 11*b*, and 11*c* have plural pores dispersed therein.

Next, via-holes are formed at predetermined positions in the insulating sheet constituting insulating layers 11*b* and 11*c*. Then, the via-holes are filled with conductive paste made of Ag powder and glass frit. This conductive paste is fired to form via-electrodes 14*a* and 14*b* (Step S104).

Then, coil conductors 12*a* and 12*b* and leading electrodes 13*a* and 13*b* are formed. Conductive patterns constituting coil conductors 12*a* and 12*b* and leading electrodes 13*a* and 13*b* are formed on a base board by plating with Ag. Then, the patterns are transferred from the base board to the insulating sheets constituting insulating layers 11*a* to 11*c*.

The method for producing these sheets is not limited to the above method, for instance, each layer can be formed by a paste printing method. The method for producing coil conductors 12*a* and 12*b*, leading electrodes 13*a* and 13*b*, and via-electrodes 14*a* and 14*b* are not limited to the above method.

Then, the sheets including the insulating sheet having the conductive patterns transferred thereto are stacked to form a laminated body. The laminated body is then cut into chips having predetermined sizes, thereby obtaining laminated bodies 1001A (Step S105). A chip component, such as common mode noise filter 1001, is produced by cutting the laminated body having a size of a square larger than of 50 mm by 50 mm into chips each having a size of a square of about 1-2 mm by 1-2 mm to obtain laminated body 1001A.

Next, laminated body 1001A is fired at a predetermined temperature for a predetermined period of time to sinter the laminated body and to generate gas from the inorganic foaming agent, thereby providing fired body 1001B (Step S106). At this moment, the inorganic foaming agent, i.e., $SrCO_3$ powder mixed in the materials of insulating layers 11*a* to 11*c* is thermally decomposed, and produces carbon dioxide gas in laminated body 1001A. The gas forms plural pores 911*a* to 911*c* in insulating layers 11*a* to 11*c* while Sr element is left in insulating layers 11*a* to 11*c*. In the case that $CaCO_3$ is used for the inorganic foaming agent, plural pores 911*a* to 911*c* are formed in insulating layers 11*a* to 11*c*, and Ca element is left in insulating layers 11*a* to 11*c*.

Then, the fired body is provided with barrel finishing (Step S107). To be more specific, about 10,000 pieces of the fired bodies are is put into a planetary mill together with media having diameters of 2 mm, SiC polishing agent, and pure water. The mill is then spun at 150 rpm for 10 minutes, thereby removing undulations on the surface of the fired bodies as well as rounding sharp portions thereon, thereby allowing external terminal electrodes 17 to be applied securely onto the fired body easily.

After the barrel finishing, the conductive paste made of Ag powder and glass frit are applied onto both sides of the fired body so that coil conductors 12*a* and 12*b* are connected with leading electrodes 13*a* and 13*b*. Then, the conductive paste is fired at a temperature of 700° C. to form external terminal electrodes 17 (Step S108).

Insulating layers 11*a* to 11*c* of common mode noise filter 1001 in accordance with Embodiment 1 contain only independent closed pores therein and few open communicating pores, hence having sufficient insulating reliability without a post treatment, such as resin impregnation. In order to obtain higher reliability, after external terminal electrodes 17 are formed, the fired body can be immersed into fluoro-silane coupling agent so that the open pores in the surface can be impregnated with resin.

The surface of each external terminal electrode 17 has a nickel-plated layer and a tin-plated layer by plating, thereby providing common mode noise filter 1001 (Step S109).

The advantage of preventing cracks from occurring in insulating layer 11*a* disposed between coil conductors 12*a* and 12*b* of common mode noise filter 1001 or 1002 in accordance with Embodiment 1 will be described below with reference to the accompanying drawings.

Glass in insulating layer 11*a* can employ, e.g. borosilicate glass having a thermal expansion coefficient ranging from 3 to 6 ppm/K. Coil conductors 12*a* and 12*b* can be made of Ag or Cu. The thermal expansion coefficients of Ag and Cu are about 19 ppm/K and 17 ppm/K, respectively, and are considerably different from the thermal expansion coefficient of borosilicate glass ranging from 3 to 6 ppm/K. Insulating layer 11*a* contains plural pores 911*a* dispersed therein, hence not having a large strength. In the case that a rigid layer made of, e.g. ferrite containing substantially no pores therein is provided on an upper surface of coil conductor 12*a* disposed on upper surface 111*a* of insulating layer 11*a* or a lower surface of coil conductor 12*b* disposed on lower surface 211*a* of insulating layer 11*a*, a thermal stress tends to concentrate on insulating layer 11*a* rather than on the rigid layer since insulating layer 11*a* has a smaller strength, hence producing cracks in insulating layer 11*a*.

In common mode noise filters 1001 and 1002 in accordance with Embodiment 1, insulating layer 11*b* containing plural pores 911*b* dispersed therein is disposed on the upper surface of coil conductor 12*a*, and insulating layer 11*c* containing plural pores 911*c* dispersed therein is disposed on the lower surface of coil conductor 12*b*. This structure allows the thermal stress to dispersedly distribute in insulating layers 11*a* and 11*b* adjacent to each other across coil conductor 12*a*. Similarly, the thermal stress dispersedly distribute in insulating layers 11*a* and 11*c* adjacent to each other across coil conductor 12*b*. This structure relieves the stress concentrating on insulating layer 11*a*, and prevents the cracks.

FIG. 7 shows a test result of common mode noise filter 1002 shown in FIG. 5 in accordance with Embodiment 1 in cracks. The thicknesses of insulating layers 11*b*, 11*c*, 16*c*, and 16*d* are changed to prepare sample No. 1 to 6. It was determined whether or not cracks are produced in insulating layer 11*a* of these samples. The total thickness of insulating layers 11*b* and 16*c* is 25 μm, and the total thickness of insulating layers 11*c* and 16*d* is also 25 μm while a thickness of insulating layer is 25 μm. Then, fifty samples of each of samples Nos. 1 to 6 are randomly chosen from about 10,000 pieces of the fired bodies having external terminal electrodes 17 formed thereon. Then, four side surfaces of each of the fifty samples are scanned with a scanning electron microscope (SEM). When a crack is observed in at least one side surface of each sample, this sample is determined as a defective. FIG. 7 shows a ratio of the number of defectives to, the number (fifty) of samples as a crack production rate.

After the firing, insulating layers 11*a*, 11*b*, 11*c*, 16*c*, and 16*d* are sintered and merged, hence preventing the interfaces between the layers from being observed with SEM. According to Embodiment 1, the interfaces between the layers are defined as follows: The interface between insulating layers 11*a* and 11*b* is defined as a line passing on a point bisecting coil conductor 12*a* in the stacking direction and extending substantially in parallel with the upper surface or the lower surface of the fired body. Similarly, the interface between insulating layers 11*a* and 11*c* is defined as a line passing on a point bisecting coil conductor 12*b* in the stacking direction and extending substantially in parallel with the upper surface or the lower surface of the fired body. The interface between insulating layers 11*b* and 16*c* is also defined as a line passing on a point bisecting leading electrode 13*a* in the stacking direction and extending substantially in parallel with the upper surface or the lower surface of the fired body. The interface between insulating layers 11*c* and 16*d* is also defined as a line passing on a point bisecting leading electrode 13*b* in the stacking direction and extending substantially in parallel with the upper surface or the lower surface of the sintered body. Since the sample of Sample No. 1 does not include insulating layer 11*b* or 11*c*, leading electrode 13*a* is disposed between insulating layer 16*c* and magnetic oxide layer 15*a*, and leading electrode 13*b* is disposed between insulating layer 16*d* and magnetic oxide layer 15*b*, thereby defining the interfaces between the layers. Since the sample of Sample No. 6 does not include insulating layer 16*c* or 16*d*, leading electrode 13*a* is disposed between insulating layer 11*b* and magnetic oxide layer 15*a*, thereby defining the interface between the layers.

The pore ratios of insulating layers 11*a* to 11*c* of the samples are 12%.

As shown in FIG. 7, Sample No. 1 exhibits a crack production rate of 41/50, larger than 80%. Sample No. 1 does not include insulating layer 11*b* or 11*c*, and the thicknesses of insulating layers 16*c* and 16*d* are 25 μm. On the other hand, Sample No. 2 exhibits a crack production rate of 5/50, 10%. Sample No. 2 includes insulating layers 11*b* and 11*c* having a thickness of 3 μm. Sample No. 2 thus has a dramatically small crack production rate. Each of Sample Nos. 3 to 6 includes insulating layers 11*b* and 11*c* having a thicknesses not smaller than 5 μm, and has a phenomenally small crack production rate of 0/50.

The crack production rates of samples which do not include insulating layer 11*b* or 11*c* and which include insulating layers 16*c* and 16*d* having a thickness of 25 μm are also measured. Leading electrodes 13*a* and 13*b* of these samples are disposed away from insulating layer 11*a* by 3 μm, 5 μm, 10 μm, 15 μm, and 25 μm. However, the distance between insulating layer 11*a* and each of leading electrodes 13*a* and 13*b* do not influence the crack production rate, so that the distance do not relate to reducing the crack production rate.

Thus, insulating layers 11*b* and 11*c* dramatically reduce the crack production rate after the firing of the conductive paste for forming external terminal electrodes 17. A thickness of each of insulating layers 11*b* and 11*c* not smaller than 5 μm can facilitate to reduce the crack production rate.

As discussed above, common mode noise filters 1001 and 1002 in accordance with Embodiment 1, insulating layer 11*a* provided between coil conductors 12*a* and 12*b* is made of glass-based material having plural pores 911*a* dispersed therein. This structure drastically reduces the stray capacitance produced between coil conductors 12*a* and 12*b*. Insulating layers 11*b* and 11*c* can prevent the structural failures, such as cracks, from occurring after the firing of external terminal electrodes 17, thus providing common mode noise filters 1001 and 1002 with excellent high-frequency characteristics at a high yield.

Exemplary Embodiment 2

Figure 8:
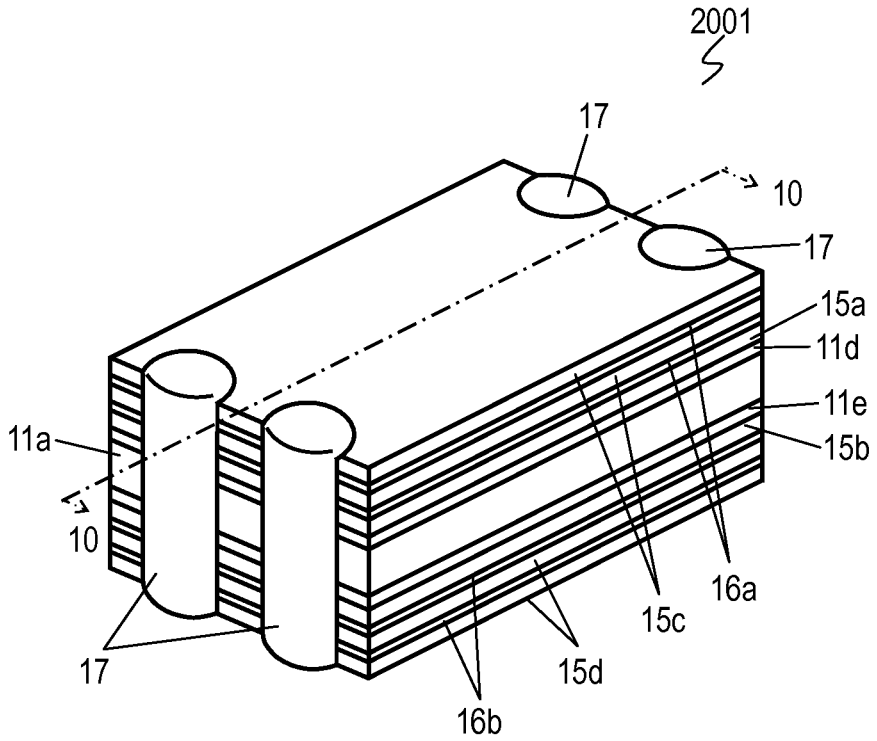
FIG. 8 is a perspective view of a common mode noise filter in accordance with Exemplary Embodiment 2 of the invention.
Figure 9:
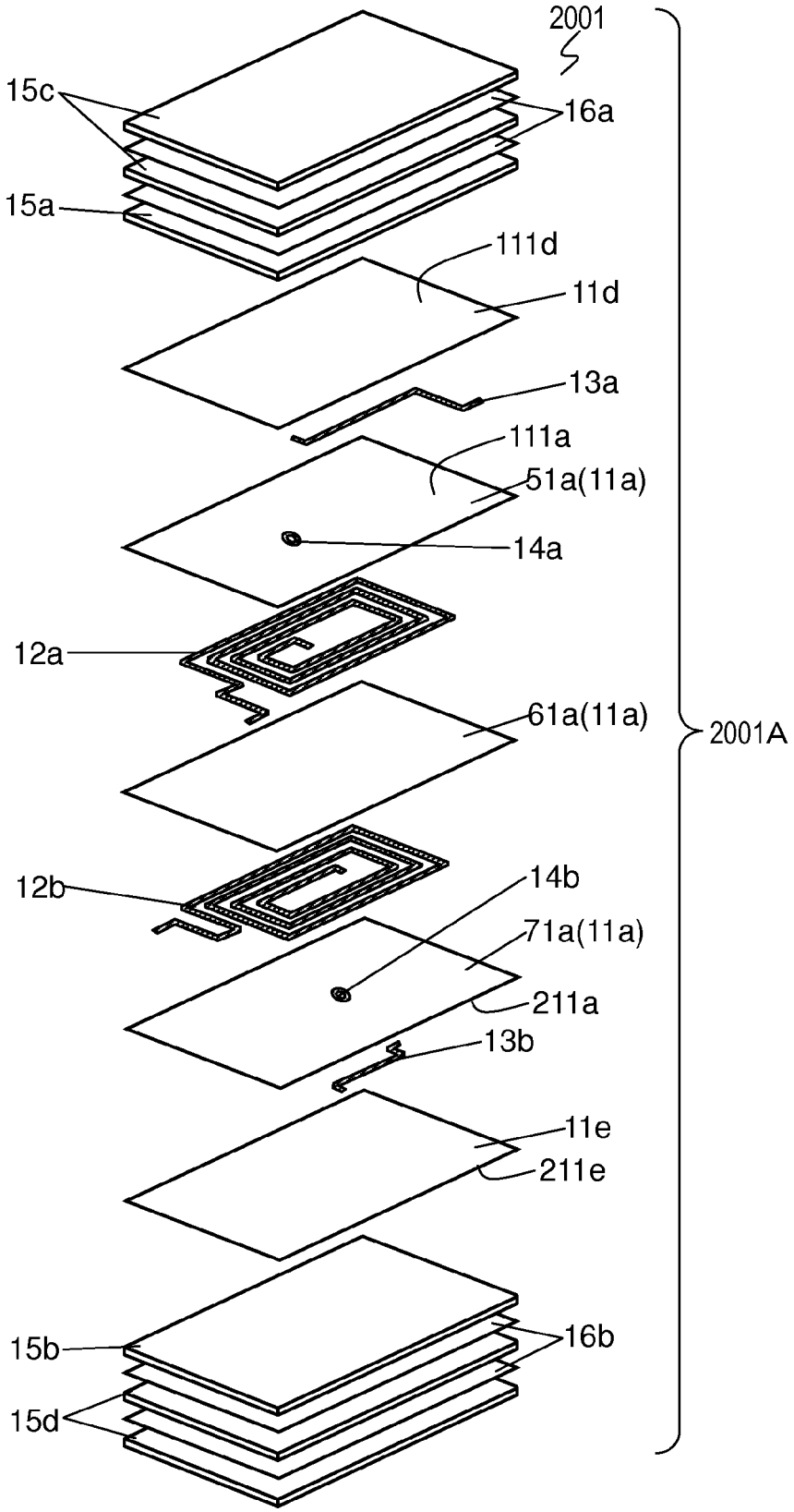
FIG. 9 is an exploded perspective view of the common mode noise filter in accordance with Embodiment 2.
Figure 10:
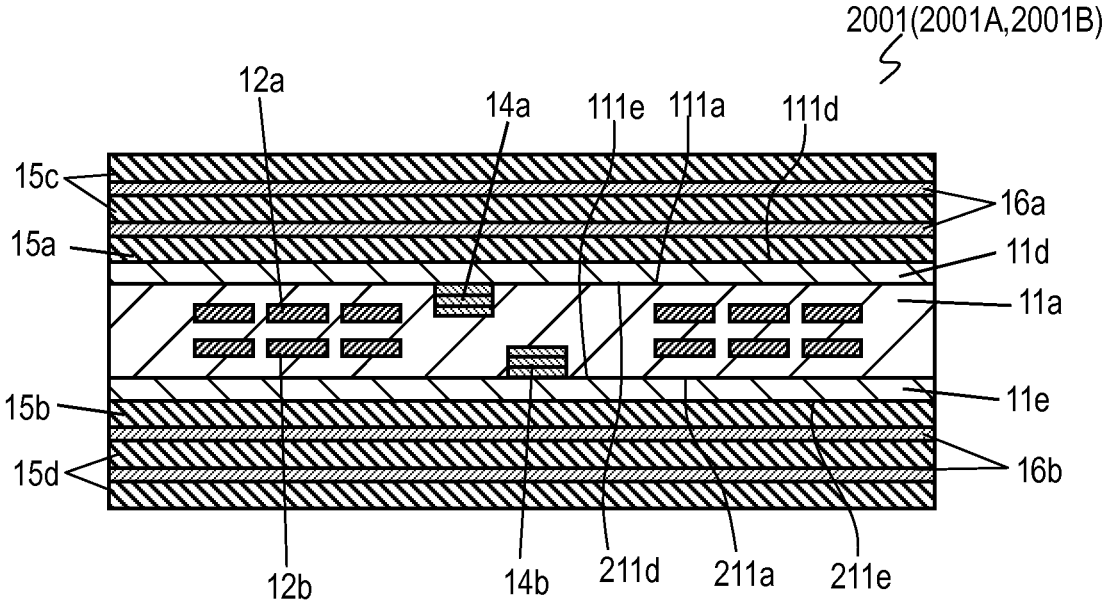
FIG. 10 is a cross-sectional view of the common mode noise filter at line 10-10 shown in FIG. 8.

FIG. 8 and FIG. 9 are a perspective view and an exploded perspective view of common mode noise filter 2001 in accordance with Exemplary Embodiment 2 of the present invention. FIG. 10 is a cross-sectional view of common mode noise filter 2001 at line 10-10 shown in FIG. 8. In FIGS. 8 to 10, components identical to those of common mode noise filter 1001 shown in FIGS. 1 to 3 are denoted by the same reference numerals.

In common mode noise filter 2001 in accordance with Embodiment 2, coil conductors 12*a* and 12*b* are embedded in insulating layer 11*a* so as not to expose coil conductors 12*a* and 12*b* to upper surface 111*a* or lower surface 211*a* of insulating layer 11*a*. Common mode noise filter 2001 includes insulating layer 11*d* disposed on upper surface 111*a* and insulating layer 11*e* disposed on lower surface 211*a* of insulating layer 11*a* instead of insulating layers 11*b* and 11*c* of common mode noise filter 1001 shown in FIGS. 1 to 3.

Common mode noise filter 2001 includes insulating layer 11*a*, magnetic oxide layer 15*a* disposed above upper surface 111*a* of insulating layer 11*a*, magnetic oxide layer 15*b* disposed below lower surface 211*a* of insulating layer 11*a*, coil conductors 12*a* and 12*b* embedded in insulating layer 11*a* and facing each other, insulating layer 11*d* disposed between upper surface 111*a* of insulating layer 11*a* and magnetic oxide layer 15*a*, and insulating layer 11*e* disposed between lower surface 211*a* of insulating layer 11*a* and magnetic oxide layer 15*b*. Magnetic oxide layer 15*a* is disposed on upper surface 111*d* of insulating layer 11*d*. Magnetic oxide layer 15*b* is disposed on lower surface 211*e* of insulating layer 11*e*. Common mode noise filter 2001 further includes leading electrodes 13*a* and 13*b* electrically connected to coil conductors 12*a* and 12*b*, respectively, via-electrodes 14*a* and 14*b* connecting coil conductors 12*a* and 12*b* to leading electrodes 13*a* and 13*b*, respectively, and external terminal electrodes 17 connected to coil conductors 12*a* and 12*b* and leading electrodes 13*a* and 13*b*. Insulating layer 11*a* contains borosilicate glass and inorganic filler. Insulating layers 11*a*, 11*d*, and 11*e* are different from magnetic oxide layers 15*a* and 15*b* in that insulating layers 11*a*, 11*d*, and 11*e* are non-magnetic layers containing substantially no magnetic properties. Insulating sheet layers 51*a*, 61*a*, and 71*a* are stacked on each other to provide insulating layer 11*a*.

Common mode noise filter 2001 further includes one or more magnetic oxide layers 15*c* made of the same material as magnetic oxide layer 15*a*, one or more magnetic oxide layers 15*d* made of the same material as magnetic oxide layer 15*b*, one or more insulating layers 16*a*, and one or more insulating layers 16*b*. Insulating layers 16*a* are stacked alternately on magnetic oxide layers 15*a* and 15*c*. Insulating layers 16*b* are stacked alternately on magnetic oxide layers 15*b* and 15*d*. Leading electrode 13*a* is disposed on upper surface 111*a* of insulating layer 11*a*. Via-electrode 14*a* penetrates insulating sheet layer 51*a* of insulating layer 11*a*. Insulating layer 11*d* is disposed on upper surface 111*a* of insulating layer 11*a* to contact and cover leading electrode 13*a*. Leading electrode 13*b* is disposed on lower surface 211*a* of insulating layer 11*a*. Via-electrode 14*b* penetrates insulating sheet layer 71*a* of insulating layer 11*a*. Insulating layer 11*e* is disposed on lower surface 211*a* of insulating layer 11*a* to contact and cover leading electrode 13*b*.

Coil conductors 12*a* and 12*b* can be formed by plating a conductive material, such as Ag, into a spiral shape, and are embedded in insulating layer 11*a*. Leading electrode 13*a* is disposed between insulating layers 11*a* and 11*d*, and leading electrode 13*b* is disposed between insulating layers 11*a* and 11*e*. Coil conductors 12*a* and 12*b* are electrically connected to leading electrodes 13*a* and 13*b* through via-electrodes 14*a* and 14*b*, respectively.

Insulating layers 11*a*, 11*d*, and 11*e* are made of glass-based non-magnetic material containing borosilicate glass and inorganic filler, and has insulating properties.

Magnetic oxide layers 15*a* and 15*b* are made of magnetic material, such as ferrite, mainly made of $Fe_2O_3$.

Figure 11:
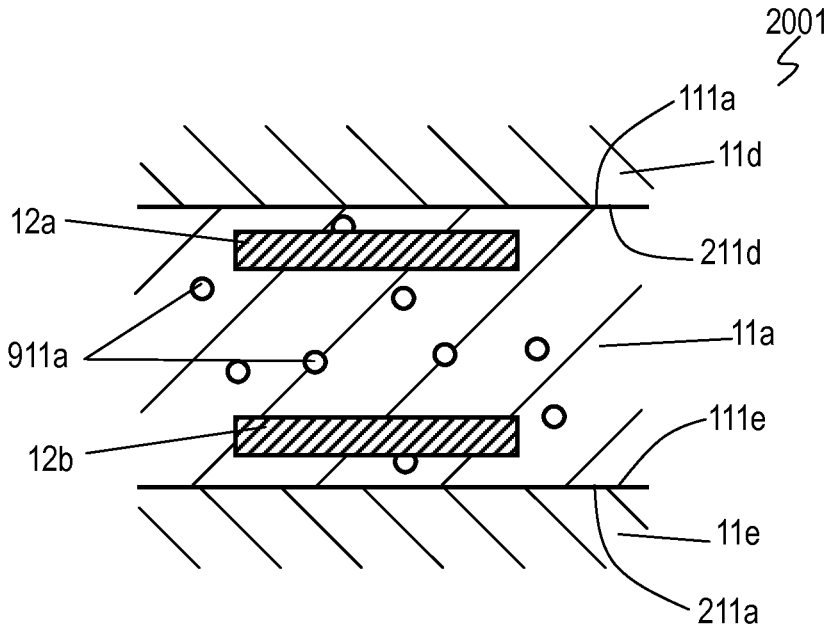
FIG. 11 is an enlarged cross-sectional view of the common mode noise filter shown in FIG. 8.

FIG. 11 is an enlarged cross-sectional view of common mode noise filter 2001. Plural pores 911*a* are dispersed in insulating layer 11*a*.

Insulating layers 11*d* and 11*e* have substantially no pores therein. This means that the glass-based material which does not contains additive for forming pores is sintered sufficiently, and the glass-based material preferably has a pore ratio not larger than 2%.

The glass composition of borosilicate glass contained in insulating layers 11*a*, 11*d*, and 11*e* preferably contains at least one material selected from $Al_2O_3$ and oxide of alkali metal in addition to $SiO_2$ and $B_2O_3$. The glass composition preferably contains substantially no PbO in order to avoid adverse affection on the environment.

The borosilicate glass contained in insulating layers 11*a*, 11*d*, and 11*e* preferably has a yield point not lower than 550° C. and not higher than 750° C. The yield point lower than 550° C. allows the glass to deform greatly during the firing, and may allow the plating to cause a problem since chemical resistance of the glass is weakened. The yield point exceeding 750° C. may cause the insulating layers to have insufficient densification in the temperature range allowing coil conductors 12*a* and 12*b* to be fired simultaneously to the insulating layers.

The inorganic filler contained in insulating layers 11*a*, 11*d*, and 11*e* can be material, such as aluminum oxide, diopside, mulite, cordierite, or silica, as long as the material has resistance to reacting with the borosilicate glass during the firing. Cordierite or silica particularly out of the above materials having a low dielectric constant may be preferably used as the inorganic filler to effectively reduce the dielectric constant of insulating layer 11*a*.

Figure 13:
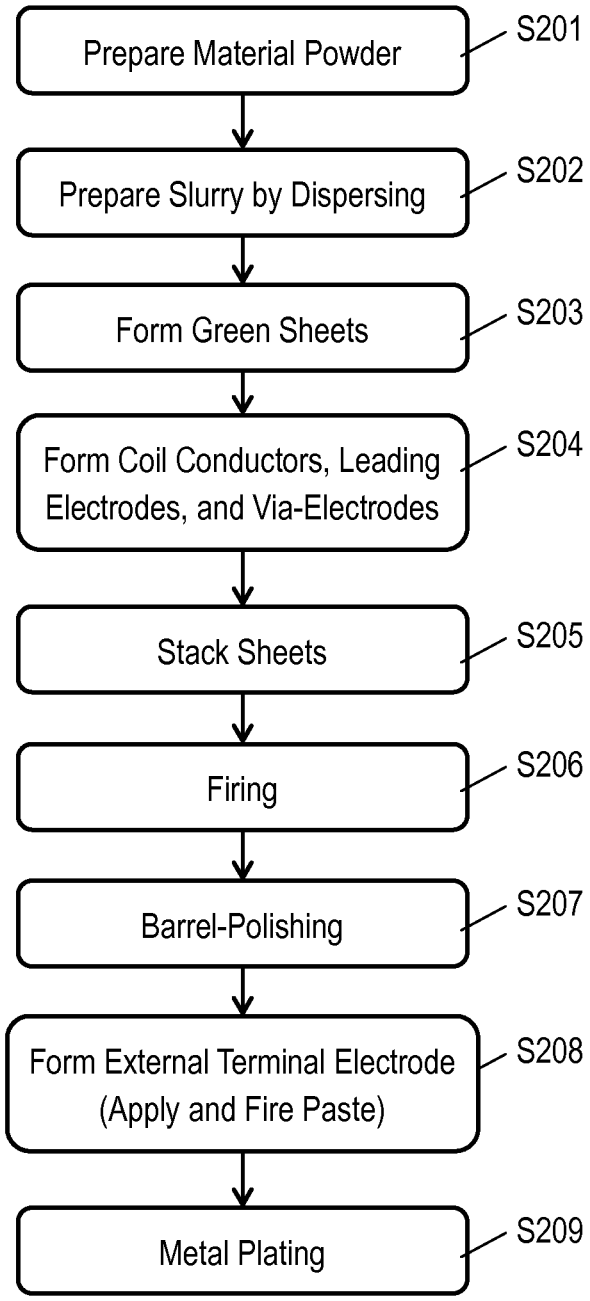
FIG. 13 is a schematic view of the common mode noise filter in accordance with Embodiment 2 for illustrating processes for manufacturing the filter.

A method for manufacturing common mode noise filter 2001 in accordance with Embodiment 2 will be described below. FIG. 13 is a flowchart illustrating processes for manufacturing common mode noise filter 2001.

First, insulating sheets constituting insulating-sheet layers 51*a*, 61*a*, and 71*a* of insulating layer 11*a* are prepared and provided. 63 wt % of borosilicate glass powder, 4 wt % of $SrCO_3$ powder, and 33 wt % of inorganic filler are mixed to produce mixed powder (Step S201). Then, butyral resin (PVB), acrylic resin, and butyl benzyl phthalate (BBP) plasticizer are mixed together to produce organic binder. Then, the mixed powder is dispersed in the organic binder, thereby producing a slurry (Step S202).

Next, this slurry is applied onto a polyethylene terephthalate (PET) film by a doctor blade method to shape the slurry, thereby obtaining an insulating sheet, i.e., a green sheet (Step S203).

Insulating sheets constituting insulating layers 11*d* and 11*e* are provided. 66 wt % of borosilicate glass powder, 34 wt % of inorganic filler are mixed together to produce mixed powder. Then, a slurry is produced from this mixed powder by the same production method of making the insulating sheet for insulating-sheet layers 51*a*, 61*a*, and 71*a*. Then, this slurry is shaped into the insulating sheets.

Magnetic oxide sheets constituting magnetic oxide layers 15*a* to 15*d* are prepared and provided. 100 wt % of ferrite material powder is prepared. Then, a slurry is made from the ferrite material powder by the same production method of the insulating sheet forming insulating-sheet layers 51*a*, 61*a*, and 71*a*. This slurry is shaped into the magnetic oxide sheets.

Insulating sheets constituting insulating layers 16*a* and 16*b* are prepared and provided: 69 wt % of borosilicate glass powder and 31 wt % of inorganic filler are mixed together to produce mixed powder. Then, a slurry is made from the mixed powder by the same production method of the insulating sheets for insulating-sheet layers 51*a*, 61*a*, and 71*a*. This slurry is shaped into the insulating sheets.

According to Embodiment 2, insulating layer 11*a*, i.e., insulating sheet layers 51*a*, 61*a*, and 71*a*, insulating layers 11*d* and 11*e* are made of the same glass and the same inorganic filler. The glass-based material increases the adhesive strength between insulating layers 11*d* and 11*e* and magnetic oxide layers 15*a* and 15*b*. The glass-based material forms a binding layer in the glasses between insulating layer 11*a* and each of insulating layers 11*d*, 11*e*, so that the binding layer may increase the adhesive strength between these layers.

Next, form via holes at predetermined places on the insulating sheet forming insulating layers 51*a* and 71*a*, and then fill the via holes with conductive paste made of Ag powder and glass frit. This conductive paste is fired to form via-electrodes 14*a* and 14*b* (Step S204).

Then, coil conductors 12*a* and 12*b* and leading electrodes 13*a* and 13*b* are formed. Conductive patterns constituting coil conductors 12*a* and 12*b* and leading electrodes 13*a* and 13*b* are formed by plating a base board with Ag, and then, are transferred from the base board onto the insulating sheets constituting insulating-sheet layers 51*a*, 61*a*, and 71*a* or insulating layers 11*d* and 11*e*.

The method for producing these sheets is not limited to the foregoing method. For instance, each layer can be formed by a paste printing method. The methods for producing coil conductors 12*a* and 12*b*, leading electrodes 13*a* and 13*b*, and via-electrodes 14*a* and 14*b* are not limited to the foregoing ones.

Then, the sheets including the insulating sheet having the conductive patterns transferred thereon are stacked to form a laminated sheet body. The laminated sheet body is then cut into pieces having predetermined sizes, thereby providing individual laminated bodies 2001A (Step S205). A chip component, such as common mode noise filter 1001, is often produced by cutting the layered sheet body having a size larger than a 50 mm square into a chip having a size of about 1-2 mm square, thereby obtaining laminated body 2001A.

Next, laminated body 2001A is fired at a predetermined temperature for a predetermined period of time to sintering the laminated body and to generate gas from the inorganic foaming agent, thereby obtaining fired body 2001B (Step S206). At this moment, the inorganic foaming agent, the $SrCO_3$ powder, mixed in the materials of insulating-sheet layer 51*a*, 61*a*, and 71*a* of insulating layers 11*a* is thermally decomposed, and produces carbon dioxide gas in laminated body 2001A. The gas produces plural pores 911*a* in each of insulating sheet layers 51*a*, 61*a*, and 71*a*, namely, insulating layer 11*a* while Sr element is left in insulating layer 11*a*. In the case that $CaCO_3$ is used as the inorganic foaming agent, plural pores 911*a* are produced in insulating layer 11*a* while Ca element is left in insulating layer 11*a*.

Then, the fired bodies are subject to barrel polishing (Step S207). To be more specific, about 10,000 pieces of the fired bodies, media having a diameter of 2 mm, SiC polishing agent, and pure water are put into a planetary mill, and spun at 150 rpm for 10 minutes, thereby smoothing undulations on surfaces of the fired bodies as well as rounding shape portions thereon, thereby allowing external terminal electrodes 17 to be thus applied securely onto the fired bodies.

After the barrel polishing, conductive pastes made of Ag powder and glass frit are applied onto both sides of each fired body such that the conductive pastes are electrically connected to coil conductors 12*a* and 12*b* and leading electrodes 13*a* and 13*b*. Then, the conductive pastes are subject to heat treatment at 700° C., thereby forming external terminal electrodes 17 (Step S208).

Insulating layers 11*a* of common mode noise filter 2001 in accordance with Embodiment 2 contain only independent closed pores therein and contains few open communicating pores, thus providing sufficient insulating reliability without a post treatment, such as resin impregnation. In order to obtain higher reliability, after external terminal electrodes 17 are formed, the fired body can be immersed into fluoro-silane coupling agent so that the open pores on the surface can be impregnated with resin.

Finally, a nickel-plated layer and a tin-plated layer are formed on the surface of each one of external terminal electrodes 17 by plating, providing common mode noise filter 2001 (Step S209).

Common mode noise filter 2001 in accordance with Embodiment 2 has a strong bonding between magnetic oxide layers 15*a*, 15*b* containing magnetic substance, such as ferrite, and insulating layer 11*a* containing pores 911*a* therein. This structure prevents delamination at the interfaces between magnetic oxide layers 15*a* and 15*b* and insulating layers 11*d* and 11*e* due to stress generated in the post steps, such as the barrel polishing, after the firing.

Common mode noise filter 2001 in accordance with Embodiment is phenomenally excellent in high-frequency characteristics due to insulating layer 11*a* made of glass-based material having pores 911*a* dispersed therein, similarly to common mode noise filter 1001 in accordance with Embodiment 1.

Insulating layer 11*a* of common mode noise filter 2001 in accordance with Embodiment 2 contains glass and inorganic filler as well as plural pores 911*a* dispersed therein. Coil conductors 12*a* and 12*b* facing each other are embedded in insulating layer 11*a* so as not to expose coil conductors 12*a* and 12*b* to upper surface 111*a* or lower surface 211*a* of insulating layer 11*a*. Magnetic oxide layer 15*a* is disposed above upper surface 111*a* of insulating layer 11*a*. Magnetic oxide layer 15*b* is disposed below lower surface 211*a* of insulating layer 11*a*. Insulating layer 11*d* containing glass and inorganic filler is disposed between magnetic oxide layer 15*a* and upper surface 111*a* of insulating layer 11*a*. Insulating layer 11*e* containing glass and inorganic filler is disposed between magnetic oxide layer 15*b* and lower surface 211*a* of insulating layer 11*a*. A total volume of the pores in insulating layer 11*d* per unit volume is smaller than a total volume of pores 911*a* of insulating layer 11*a* per unit volume. A total volume of the pores in insulating layer 11*e* per unit volume is smaller than the total volume of pores 911*a* of insulating layer 11*a* per unit volume. Insulating layers 11*d* and 11*e* may contain substantially no pore therein.

Common mode noise filter 2001 in accordance with Embodiment 2 can obtain strong bonding on the interfaces between insulating layers 11*d* and 11*e* and magnetic oxide layers 15*a* and 15*b* for the following reasons.

In the case that non-magnetic ferrite material, such as Cu—Zn based material is used for insulating layer 11*a*, upon directly contacting magnetic oxide layers 15*a* and 15*b*, insulating layer 11*a* produces a reaction layer between insulating layer 11*a* and the ferrite material in magnetic oxide layers 15*a* and 15*b* due to inter-diffusion during the firing, so that the reaction layer provides the strong bonding. In the case that glass-based material is used for insulating layer 11*a* in accordance with Embodiment 2, insulating layer 11*a* does not produce the reaction layer, and only fusion force of the glass is obliged to maintain a secure contact between these layers. In the case that the glass-based material containing plural pores 911*a* therein is used for insulating layer 11*a*, pores 911*a* exist on the interfaces between insulating layer 11*a* and each of magnetic oxide layers 15*a* and 15*b*, and reduce an actual fused area of the glass, hence hardly maintain the secure contact.

In common mode noise filter 2001 in accordance with Embodiment 2, insulating layer 11*d* is disposed between magnetic oxide layer 15*a* and insulating layer 11*a*, and insulating layer 11*e* is disposed between magnetic oxide layer 15*b* and insulating layer 11*a*. Each of a total volume of pores per unit volume contained in insulating layer 11*d* and that of layer 11*e* is smaller than that of insulating layer 11*a*. This structure increases the fused area between magnetic oxide layer 15*a* and insulating layer 11*d*, and also increases the fused area between magnetic oxide layer 15*b* and insulating layer 11*e*, accordingly allowing magnetic oxide layer 15*a* to be strongly bonded to insulating layer 11*d* and allowing magnetic oxide layer 15*b* to be strongly bonded to insulating layer 11*e*. Insulating layers 11*d* and 11*e* to be bonded to magnetic oxide layers 15*a* and 15*b* are made of glass-based material similarly to insulating layer 11*a*. A fused area of the interface (i.e. upper surface 111*a* of insulating layer 11*a*) between insulating layers 11*d* and 11*a* becomes smaller, and a fused area of the interface (i.e. lower surface 211*a* of insulating layer 11*a*) between insulating layers 11*e* and 11*a* becomes also smaller. However, microscopic individual fused parts have no interfaces and they are unified, so that insulating layers 11*a*, 11*d*, and 11*e* are bonded to each other strongly.

FIG. 12 shows a test result of common mode noise filter 2001 in accordance with Embodiment in delamination. Samples of Sample Nos. 7 to 12 have different thicknesses of insulating layers 11*d* and 11*e*. The delamination is checked on the interface between insulating layer 11*d* and magnetic oxide layer 15*a* and on the interface between insulating layer 11*e* and magnetic oxide layer 15*b*. In these samples, a distance between coil conductors 12*a* and 12*b*, namely, a thickness of insulating-sheet layer 61*a* of insulating layer 11*a*, is 25 μm. A distance between coil conductor 12*a* and insulating layer 11*d*, namely, a thickness of insulating-sheet layer 51*a* of insulating layer 11*a*, is 25 μm. A distance between coil conductor 12*b* and insulating layer 11*e*, namely, a thickness of insulating-sheet layer 71*a* of insulating layer 11*a*, is 25 μm. Fifty samples are randomly chosen for each of sample Nos. 7 to 12 from about 10,000 pieces after the firing and the barrel polishing. Four side surfaces of each of the fifty samples are observed with a scanning electron microscope (SEM). A sample exhibiting a delamination on at least one side surface is regarded as a defective.

Insulating layers 11*a*, 11*d*, and 11*e* are sintered and unified. In the case that these layers are made of the same material, even the observation with SEM may not distinctively find the interfaces between these layers. However, In the above manufacturing method, leading electrode 13*a* is disposed between insulating layers 11*a* and 11*d*, and leading electrode 13*b* is disposed between insulating layers 11*a* and 11*e*, so that the interfaces between these layers can be clearly defined as leading electrodes 13*a* and 13*b*.

Next, a method for measuring a volume of pores in insulating layers 11*a*, 11*d*, and 11*e* per unit volume will be described below.

First, a place at which the volume of pores is measured in each layer per unit volume will be described. The volume of pores 911*a* in insulating layer 11*a* per unit volume is obtained by measuring the volume of pores 911*a* between coil conductors 12*a* and 12*b*. The volume of the pores in insulating layer 11*d* is obtained by measuring the volume thereof between magnetic oxide layer 15*a* and coil conductor 12*a*. The volume of the pores in insulating layer 11*e* is obtained by measuring thereof between magnetic oxide layer 15*d* and coil conductor 12*b*. Photographs of five sections of the fired body captured with SEM are image-processed to calculate area SP of the pores in each layer and whole cross sectional area SB of the fired body. The volume of the pores per unit volume, namely, a pore ratio TV, is obtained by the following formula:

$$TV=SP^{3/2}/SB^{3/2}$$

The pore ratio of insulating layers 11*a* of the samples shown in FIG. 12 is 12%. As shown in FIG. 12, sample No. 7 does not include insulating layers 11*d* or 11*e*, and insulating layer 11*a* directly contact magnetic oxide layers 15*a* and 15*b*. The delamination is exhibited in Sample No. 7 at a rate of 37/50, namely, greater than 70%. Sample No. 8 includes insulating layers 11*d* and 11*e*. The delamination is exhibited in Sample No. 8 at a rate of 7/50, namely, about 15%. Each of Sample Nos. 9 to 12 includes thicker insulating layers 11*d* and 11*e* than the other samples. The delamination is exhibited in Sample Co. 9 to 12 at a rate of 0/50, providing excellent result.

As discussed above, insulating layers 11*d* and 11*e* provided between insulating layer 11*a* and each of magnetic oxide layers 15*a* and 15*b* reduces the ratio of delamination after the barrel polishing.

In common mode noise filter 2001 in accordance with Embodiment 2, coil conductors 12*a*, 12*b* are disposed inside insulating layer 11*a* made of glass-based material and having plural pores 911*a* dispersed therein. This structure reduces a stray capacitance produced between coil conductors 12*a* and 12*b*, and provides common mode noise filter 2001 with phenomenally excellent high-frequency characteristics. Insulating layer 11*d* having substantially no pore dispersed therein is disposed between insulating layer 11*a* and magnetic oxide layer 15*a*. Insulating layer 11*e* having substantially no pore dispersed therein is disposed between insulating layer 11*a* and magnetic oxide layer 15*b*. This structure can reduce the delamination between magnetic oxide layer 15*a* and insulating layer 11*d* and the delamination between magnetic layer 15*b* and insulating layer 11*e*, providing a high yield rate.

Insulating layers 11*d* and 11*e* of common mode noise filter 2001 in accordance with Embodiment 2 may contain pores dispersed therein. A total volume of the pores in each of insulating layers 11*d* and 11*e* per unit volume is preferably smaller than a total volume of pores 911*a* in insulating layer 11*a* per unit volume. This structure prevents the delamination between each of magnetic oxide layers 15*a* and 15*b* and each of insulating layers 11*d* and 11*e*. In this case, when the insulating sheets constituting insulating layers 11*d* and 11*e* are prepared, the inorganic foaming agent is added to the mixed powder that is the material for the insulating sheets, similarly to the filter according to Embodiment 1.

Each of common mode noise filters 1001, 1002 and 2001 in accordance with Embodiments 1 and 2 includes two coil conductors 12*a* and 12*b*, but the number of the coils is not necessarily two. For instance, each of common mode noise filters 1001, 1002 and 2001 in accordance with Embodiments 1 and 2 may be an array-type filter including plural pairs of coil conductors 12*a* and 12*b* facing each other.

In Embodiments 1 and 2, terms, such as "upper surface", "lower surface", "above", and "below" indicating directions merely indicate relative directions depending only on relative positional relations of structural components, such as the insulating layers and the magnetic oxide layers, of the common mode noise filters, and do not indicate absolute directions, such as a vertical direction.

INDUSTRIAL APPLICABILITY

A common mode noise filter according to the present invention can prevent cracks from produced therein, can work at a high-frequency band, and can be manufactured at a high yield rate, thus being useful for reducing noises in various electronic apparatuses, such as digital devices, audio-visual devices, and information communication terminals.

REFERENCE MARKS IN THE DRAWINGS

11*a* Insulating Layer (First Insulating Layer)
11*b* Insulating Layer (Second Insulating Layer)
11*c* Insulating Layer (Third Insulating Layer)
11*d* Insulating Layer (Second Insulating Layer)
11*e* Insulating Layer (Third Insulating Layer)
12*a* Coil Conductor (First Coil Conductor)
12*b* Coil Conductor (Second Coil Conductor)
15*a* Magnetic Oxide Layer (First Magnetic Oxide Layer
15*b* Magnetic Oxide Layer (Second Magnetic Oxide Layer
16*c* Insulating Layer (Fourth Insulating Layer)
16*d* Insulating Layer (Fifth Insulating Layer)
17 External Terminal Electrode
51*a* Insulating Layer (Second Insulating Layer)
61*a* Insulating Layer (First Insulating Layer)
71*a* Insulating Layer (Third Insulating Layer)
911*a* Pore (First Pore)
911*b* Pore (Second Pore)
911*c* Pore (Third Pore)
1001 Common Mode Noise Filter
1002 Common Mode Noise Filter
2001 Common Mode Noise Filter

The invention claimed is:

1. A common mode noise filter comprising:

a first insulating layer containing glass and inorganic filler, the first insulating layer containing a plurality of pores dispersed therein;

a first coil conductor disposed on an upper surface of the first insulating layer;

a second coil conductor disposed on a lower surface of the first insulating layer, the second coil conductor facing the first coil conductor across the first insulating layer;

a second insulating layer disposed on the upper surface of the first insulating layer to cover the first coil conductor, the second insulating layer containing glass and inorganic filler, the second insulating layer containing a plurality of pores dispersed therein;

a third insulating layer disposed on the lower surface of the second insulating layer to cover the second coil conductor, the third insulating layer containing glass and inorganic filler, third insulating layer containing a plurality of pores dispersed therein;

a first magnetic oxide layer disposed above an upper surface of the second insulating layer; and a second magnetic oxide layer disposed below a lower surface of the third insulating layer such that the first insulating layer, the second insulating layer, and the third insulating layer are provided between the first magnetic oxide layer and the second magnetic oxide layer, wherein:

the first insulating layer includes a portion provided between the first coil conductor and the second coil conductor, an entire lower surface of the first coil conductor and an entire upper surface of the second coil conductor contact the portion of the first insulating layer, a pore ratio, which is a ratio of a total volume of the plurality of pores to a volume of the portion of the first insulating layer, ranges from 5 to 40 vol. %, and the pores in the first insulating layer are only independent closed pores.

2. The common mode noise filter according to claim 1, wherein the first magnetic oxide layer is disposed on the upper surface of the second insulating layer.

3. The common mode noise filter according to claim 2, wherein the second magnetic oxide layer is disposed on the lower surface of the third insulating layer.

4. The common mode noise filter according to claim 1, further comprising:

a first leading electrode disposed on the upper surface of the second insulating layer and connected electrically to at least one of the first coil conductor and the second coil conductor; and a fourth insulating layer disposed on the upper surface of the second insulating layer to cover the first leading electrode, the fourth insulating layer containing glass component, wherein the first magnetic oxide layer is disposed on an upper surface of the fourth insulating layer.

5. The common mode noise filter according to claim 4, further comprising:

a second leading electrode disposed on the lower surface of the third insulating layer and connected electrically to at least one of the first coil conductor and the second coil conductor; and a fifth insulating layer disposed on the lower surface of the third insulating layer to cover the second electrode, the fifth insulating layer containing glass component, wherein the second magnetic oxide layer is disposed on a lower surface of the fifth insulating layer.

6. The common mode noise filter according to claim 1, wherein a pore ratio, which is a ratio of a total volume of pores contained in the second insulating layer to a volume of the second insulating layer, is not larger than 2 vol. %.

7. The common mode noise filter according to claim 6, wherein a pore ratio, which is a ratio of a total volume of pores contained in the third insulating layer to a volume of the third insulating layer, is not larger than 2 vol. %.

8. The common mode noise filter according to claim 1, wherein the first insulating layer includes Ce.

9. A common mode noise filter comprising:

a first insulating layer containing glass and inorganic filler, the first insulating layer containing a plurality of first pores dispersed therein;

a first coil conductor provided in the first insulating layer so as not to be exposed to an upper surface and a lower surface of the first insulating layer;

a second coil conductor provided in the first insulating layer so as not to be expose to the upper surface and the lower surface of the first insulating layer, the second coil conductor facing the first coil conductor across a part of the first insulating layer;

a second insulating layer disposed on the upper surface of the first insulating layer, the second insulating layer containing glass and inorganic filler;

a third insulating layer disposed on the lower surface of the first insulating layer such that the first insulating layer is provided between the second insulating layer and the third insulating layer, the third insulating layer containing glass and inorganic filler;

a first magnetic oxide layer disposed above an upper surface of the second insulating layer; and a second magnetic oxide layer disposed below a lower surface of the third insulating layer, wherein:

the first insulating layer includes a portion contacting an upper surface and a lower surface of the first coil conductor and contacting an upper surface and a lower surface of the second coil conductor, and a total volume of pores contained in the second insulating layer per unit volume and a total volume of pores contained in the third insulating layer per unit volume are smaller than a total volume of the plurality of first pores in the portion of the first insulating layer per unit volume.

10. The common mode noise filter according to claim 9, wherein the second insulating layer contains substantially no pore dispersed therein, and wherein the third insulating layers contains substantially no pore dispersed therein.

11. The common mode noise filter according to claim 1 or 9, wherein thicknesses of the second insulating layer and the third insulating layer are not smaller than 5 μm.

12. The common mode noise filter according to claim 1 or 9, wherein the first insulating layer, the second insulating layer, and the third insulating layer comprise alkaline earth metal element.

13. The common mode noise filter according to claim 1 or 9, wherein the glass contained in the first insulating layer and the glass contained in the second insulating layer are made of a same material, wherein the glass contained in the first insulating layer and the glass contained in the third insulating layer are made of a same material, wherein the inorganic filer contained in the first insulating layer and the inorganic filer contained in the second insulating layer are made of a same material, and wherein the inorganic filler contained in the first insulating layer and the inorganic filer contained in the third insulating layer are made of a same material.

14. The common mode noise filter according to claim 1 or 9, wherein the first insulating layer, the second insulating layer, and the third insulating layer contain borosilicate glass and silica filler.

15. The common mode noise filter according to claim 9, wherein a pore ratio, which is a ratio of a total volume of the plurality of first pores to a volume of the first insulating layer, ranges from 5 to 40 vol. %.

16. The common mode noise filter according to claim 15, wherein a pore ratio, which is a ratio of the total volume of the pores contained in the second insulating layer to a volume of the second insulating layer, is not larger than 2 vol. %.

17. The common mode noise filter according to claim 16, wherein a pore ratio, which is a ratio of the total volume of the pores contained in the third insulating layer to a volume of the third insulating layer, is not larger than 2 vol. %.

18. The common mode noise filter according to claim 9, wherein the plurality of first pores in the first insulating layer are only independent closed pores.

19. The common mode noise filter according to claim 9, wherein the upper surface and the lower surface of the first coil conductor and the upper surface and the lower surface of the second coil conductor entirely contact the portion of the first insulating layer.

20. The common mode noise filter according to claim 9, wherein the second insulating layer and the third insulating layer contact none of the first coil conductor and the second coil conductor.

* * * * *